US008503702B2

(12) United States Patent
Kao et al.

(10) Patent No.: US 8,503,702 B2
(45) Date of Patent: Aug. 6, 2013

(54) ELECTRET DIAPHRAGM AND SPEAKER USING THE SAME

(75) Inventors: Che-I Kao, Tainan County (TW); Chih-Kung Lee, Taipei (TW); Wen-Ching Ko, Kaohsiung (TW); Chang-Ho Liou, Changhua County (TW); Ing-Yih Leu, Taipei (TW); Ming-Daw Chen, Hsinchu (TW); Yi-Jen Chan, Taoyuan County (TW); Chien-Kai Tseng, Taipei (TW)

(73) Assignees: Industrial Technology Research Institute, Hsinchu (TW); National Taiwan University, Taipei (TW)

( * ) Notice: Subject to any disclaimer, the term of this patent is extended or adjusted under 35 U.S.C. 154(b) by 298 days.

(21) Appl. No.: 12/909,842

(22) Filed: Oct. 22, 2010

(65) Prior Publication Data

US 2011/0255720 A1 Oct. 20, 2011

Related U.S. Application Data

(60) Provisional application No. 61/254,104, filed on Oct. 22, 2009.

(51) Int. Cl.
*H04R 25/00* (2006.01)
*H04R 7/00* (2006.01)

(52) U.S. Cl.
USPC ..... 381/191; 181/157

(58) Field of Classification Search
USPC ..... 381/191
See application file for complete search history.

(56) References Cited

U.S. PATENT DOCUMENTS

| | | | | |
|---|---|---|---|---|
| 4,527,218 | A | 7/1985 | von Seggern | |
| 4,891,843 | A * | 1/1990 | Paulus et al. | 381/191 |
| 6,409,806 | B1 | 6/2002 | Jones et al. | |
| 6,432,175 | B1 | 8/2002 | Jones et al. | |
| 8,098,855 | B2 * | 1/2012 | Lee et al. | 381/191 |
| 2002/0080684 | A1 * | 6/2002 | Donskoy et al. | 367/140 |
| 2009/0245547 | A1 * | 10/2009 | Lee et al. | 381/191 |
| 2009/0296963 | A1 * | 12/2009 | Akino | 381/174 |
| 2010/0272287 | A1 * | 10/2010 | Miller, III | 381/92 |

FOREIGN PATENT DOCUMENTS

| | | | |
|---|---|---|---|
| JP | 2005-191467 | * | 7/2005 |
| TW | I264960 | | 10/2006 |
| TW | I294250 | | 3/2008 |
| TW | 201008304 | | 2/2010 |

OTHER PUBLICATIONS

R. Gerhard-Multhaupt, X. Zhengfu, W. Kunstler, A. Pucher; "Preliminary study of multi-layer space-charge electrets with piezoelectric properties from porous and non-porous Teflon films"; Proceedings 10th International Symposium on Electrets, 1999; pp. 273-276.*

S.M. S M Song, J. Jiang, L.L. Cui, X.P. Wang, Z.F. Xia; "Preparation of porous PTFE/PE/PP composite electret and study of its charge storage stability"; 12th International Symposium on Electrets; 2005; pp. 63-66.*

Wen-Ching Ko, Chien-Kai Tseng, Wen-Jong Wu, Chih-Kung Lee, "Charge storage and mechanical properties of porous PTFE and composite PTFE/COC electrets", e-Polymers 2010, No. 032, p. 1-p. 10, http://www.e-polymers.org, ISSN 1618-7229, published on Mar. 17, 2010.

* cited by examiner

*Primary Examiner* — Brian Ensey
*Assistant Examiner* — Sabrina Diaz
(74) *Attorney, Agent, or Firm* — Jianq Chyun IP Office

(57) ABSTRACT

An electret diaphragm and a speaker using the same are provided. The electret diaphragm includes an electret layer, a bonding layer adhered to a surface of the electret layer, and an aluminum (Al) electrode layer adhered on the bonding layer. The electret layer at least includes ethylene group polymer. A material of the bonding layer is ethylene-ethyl-acrylate (EEA) or ethylene-vinyl acetate (EVA).

21 Claims, 11 Drawing Sheets

ELECTRET DIAPHRAGM AND SPEAKER USING THE SAME

CROSS-REFERENCE TO RELATED APPLICATION

This application claims the priority benefit of U.S.A. provisional application Ser. No. 61/254,104, filed on Oct. 22, 2009, all disclosures are incorporated therewith.

TECHNICAL FIELD

The disclosure relates to an electret diaphragm and a speaker using the same.

BACKGROUND

Recently, flexible and plane speakers in futuristic applications have generated much interest. Application in areas such as 3C (computer, communication and consumer electronics), smart windows, smart curtains, automobile audio and toys have been actively discussed. However, some novel sound generating techniques are not completely suitable for futuristic audio systems needs, such as energy-saving, flexible structure and design freedom of shape, etc. Hence, concerns with electret flexible speaker improvements are growing and have been perfected to complete the idea.

A traditional type of electret actuators has been studied since the 1970s. Taking a typical structure, an electret-based diaphragm is placed beside perforated electrode layers and separated by a set of spacers. The speaker operates in membrane vibration mode, interaction between the externally applied voltage and space charge of an electret induced vibration on the diaphragm is done by varying the electrostatic force which in turn induced acoustic waves to be radiated. Results show that the inherent advantages included a simple and compact construction, better efficiency, and excellent high-frequency response. Hence, from Coulomb's law, to obtain a high efficiency electret speaker, the electret diaphragm should possess high charge storage and a light mass. By effectively enhancing the charge density, we can obtain an efficient device.

To obtain a high performance electret speaker, the electret diaphragm should possess good charge storage capability and a light mass. By effectively enhancing the charge density, we can obtain an efficient device. Porous polytetrafluoroethylene (PTFE) films are recognized as great electret material with excellent charge-storage capabilities. However, despite the advantages and benefits of porous PTFE, disadvantages include characteristics such as a difficulty to adhere to an electrode layer layer, a medium charge storage stability at high porosity thin-film, a low elastic modulus, and easy plastic deformation at low stress. These disadvantages have hindered the further development of flexible electret speakers. Some studies have attempted to improve the properties of porous PTFE which adopt coating and lamination methods to form a composite material. However, the resulting composite material becomes less conformable than desired. Although difficult to achieve, the ideal properties for a good electret diaphragm include features such as low cost, a good adhesion between the electrode layer and the PTFE, and a light mass.

SUMMARY

Embodiments disclosed herein may provide an electret diaphragm. The electret diaphragm comprises an electret layer, a bonding layer adhered to a surface of the electret layer, and an aluminum (Al) electrode layer adhered to the bonding layer. The electret layer at least includes ethylene group polymer. A material of the bonding layer includes ethylene-ethyl-acrylate (EEA) or ethylene-vinyl acetate (EVA).

Embodiments disclosed herein may further provide a speaker. The speaker at least includes a perforated electrode layer and the above-mentioned electret diaphragm opposite to the perforated electrode layer. The electret diaphragm includes an electret layer, a bonding layer adhered to a surface of the electret layer, and an aluminum (Al) electrode layer adhered to the bonding layer.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF THE EMBODIMENTS

Figure 1:
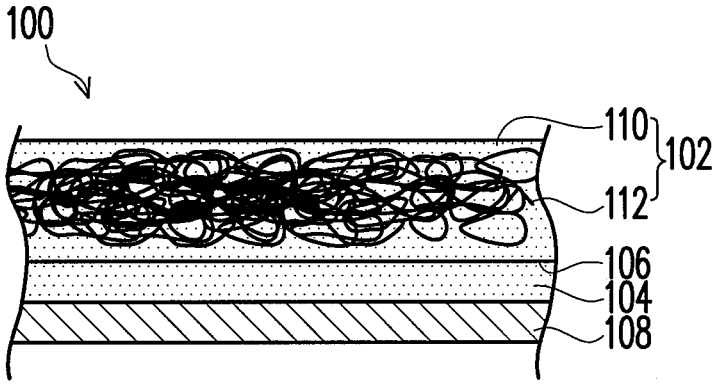
FIG. 1 is a schematic, cross-sectional view diagram illustrating an electret diaphragm according to an exemplary embodiment of the disclosure.

FIG. 1 is a schematic, cross-sectional view diagram illustrating an electret diaphragm according to an exemplary embodiment of the disclosure.

Referring to FIG. 1, the electret diaphragm 100 includes an electret layer 102, a bonding layer 104 adhered to a surface 106 of the electret layer 102, and an aluminum (Al) electrode layer 108 adhered to the bonding layer 104. The electret layer 102 at least includes ethylene group polymer 110. For example, in this exemplary embodiment, the electret layer 102 is composed by a base material of fluorine polymer 112 and an added material of ethylene group polymer 110.

The ethylene group polymer 110 may include cyclic olefin copolymer (COC), polyvinyl chloride (PVC), polyethylene (PE), or one selected from these materials blended with at least one of following materials, polystyrene (PS), polycarbonate (PC), poly(methyl methacrylate) (PMMA), polyimide (PI), polyetherimide (PEI), poly(2,6-dimethyl-1,4-phenylene ether (PPE), polypropylene (PP), high density polyethylene (HDPE), polyurethane (PU), poly(etheretherketone) (PEEK) and poly(etherimide) (PEI).

The base material of fluorine polymer 112 may include fabric type polymer, nonwoven type polymer, or porous type polymer, preferably porous type polymer as shown in FIG. 1. For example, the porous, type polymer includes polytetrafluoroethylene (PTFE), tetrafluoroethylene, fluoroethylenepropylene (FEP), poly(ethylene tetrafluoroethylene) (ETFE) or polytetrafluoroethylene co-perfluoroalkoxy (PFA); the nonwoven type polymer includes FEP, ETFE or PFA.

The ethylene group polymer 110 has excellent adhesion to the bonding layer 104. The ethylene group polymer 110 may be composed with the base material of fluorine polymer 112 by filling pores and holes within the base material of fluorine polymer 112.

A material of the bonding layer 104 includes ethylene-ethyl-acrylate (EEA), ethylene-vinyl acetate (EVA) and so on.

Figure 2A:
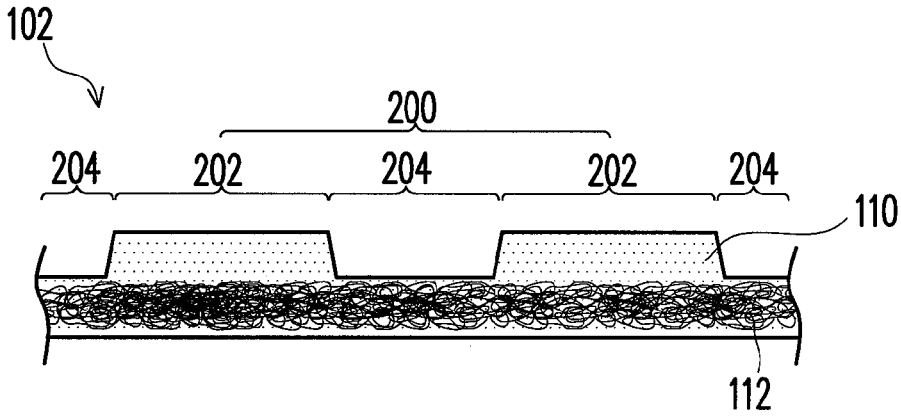
FIGS. 2A and 2B are a schematic, cross-sectional view diagrams illustrating two example of the electret layer of FIG. 1.

In one embodiment, the electret layer 102 can be formed having a pattern 200 constituted by thick portions 202 and thin portions 204 as shown in FIG. 2A. Since the electret layer 102 has different thickness in different region, and the thickness difference significantly effects each cell within a speaker. Therefore, the frequency response of the speaker can be enhanced through control of the thickness in each cell.

Figure 2B:
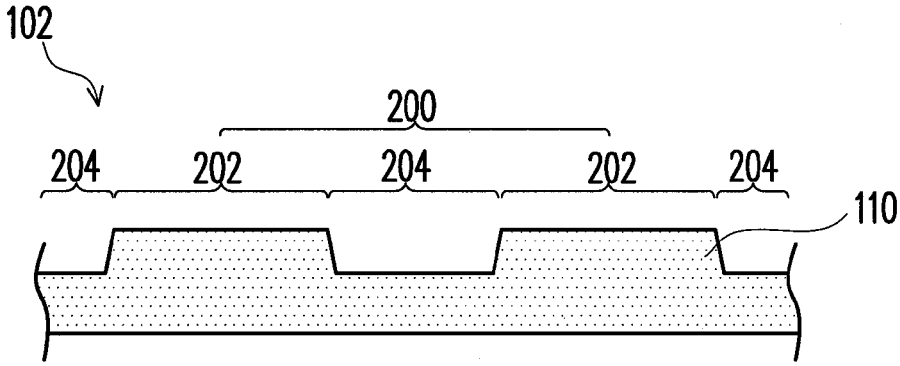

Alternatively, in FIG. 2B, the electret layer 102 may only include the ethylene group polymer 110 such as a COC layer. Since the electret layer 102 may be prepared by a solution process, it is possible to form the thick portions 202 of the pattern 200 according to ordinary skill. For clarity, the bonding layer 104 and the Al electrode layer 108 are not shown in FIGS. 2A and 2B.

Figure 2C:
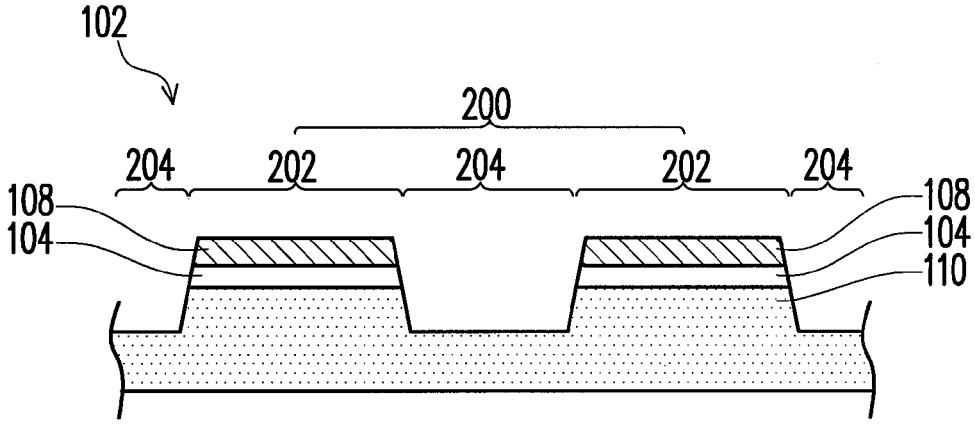
FIG. 2C is a schematic, cross-sectional view diagram illustrating another example of the electret diaphragm of FIG. 1.

FIG. 2C is a schematic, cross-sectional view diagram illustrating another example of the electret diaphragm of FIG. 1. In FIG. 2C, the Al electrode layer 108 is disposed in the thick portions 202 except for the thin portions 204. The discontinued Al electrode layer 108 may formed by printing the bonding layer 104 on the electret layer 102 within the thick portions 202, plating entire Al electrode layer, and then rinsing the Al electrode layer to remove the Al electrode layer in the thin portions 204.

In addition, since the adhesion between the Al electrode layer 108 and the bonding layer 104 is stronger than that between the Al electrode layer 108 and the ethylene group polymer 110, even if the electret layer 102 is a plane without the pattern 200 in FIG. 2C, it is possible to pattern the bonding layer 104 by inject printing or screen printing, and then further pattern the Al electrode layer 108, which may be formed by sputtering or Physical Vapor Deposition (PVD) process, to the predetermined shape by some rinsing process. Thus, conventional processes for patterning Al electrode, such as photolithography and etching may be omitted.

Figure 2D:
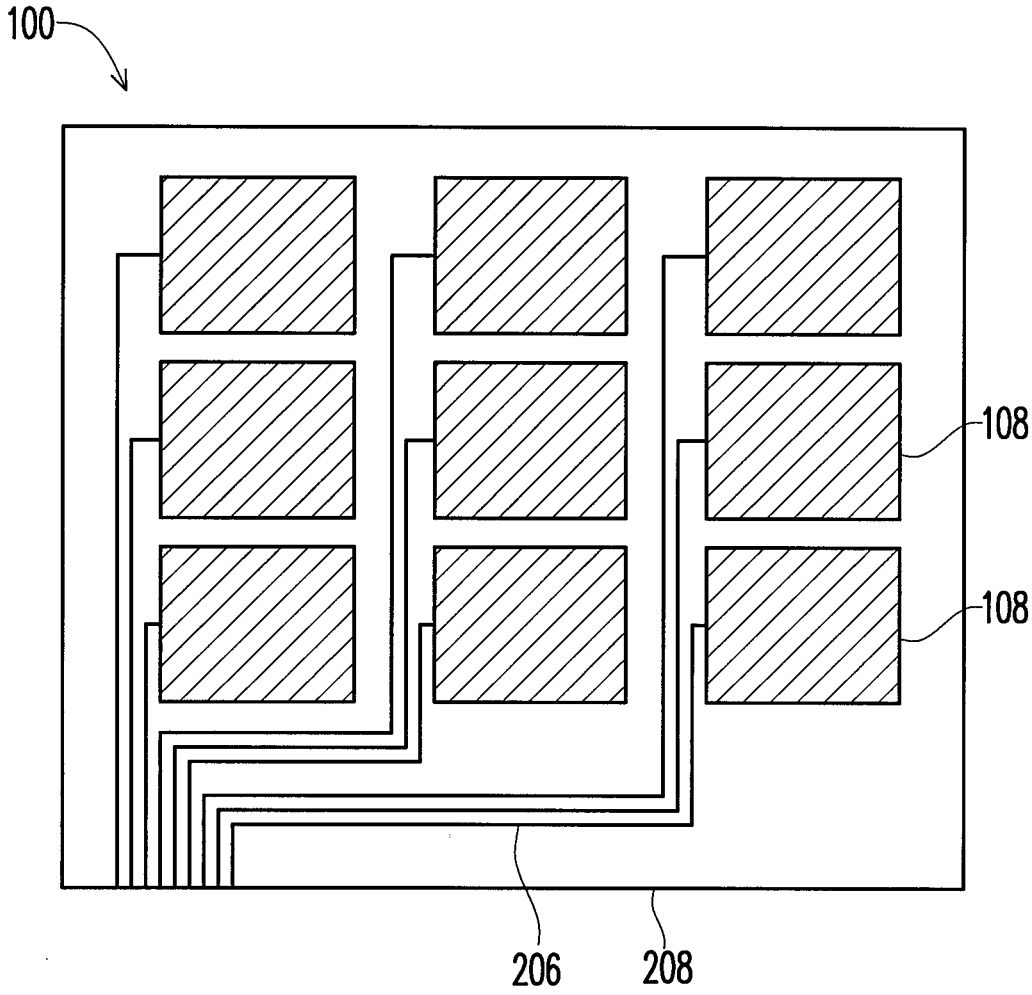
FIG. 2D is a schematic, plan view diagram illustrating one example of the patterned bonding layer and the patterned Al electrode layer of FIG. 1.

Adopting above mentioned methods, the bonding layer 104 and the Al electrode layer 108 can be patterned into discontinued array patterns as show in FIG. 2D. For clarity, it only shows the Al electrode layer 108, and each of the disconnected array patterns (i.e. the Al electrode layer 108) has a wire 206 coming to one edge 208 of the electret diaphragm 100, for example. This disconnected Al electrode layer 108 can form individually-controlled electret cell array, and thus it is possible to accomplish arrayed multi-channel speaker. By further controlling the multiple speaker channels in phase delayed signals, audio beam steering could be realized. As the same reason, the bonding layer 104 and the Al electrode layer 108 may be patterned to partially connected array patterns and partially disconnected array patterns, alternatively.

Figure 3A:
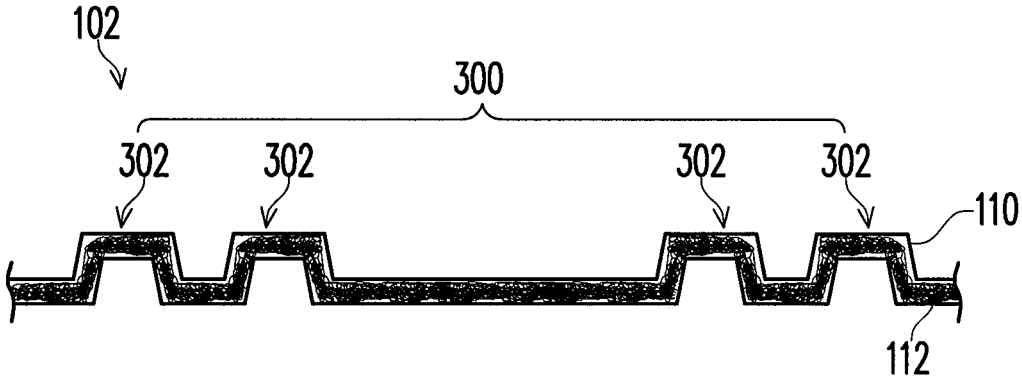
FIGS. 3A and 3B are a schematic, cross-sectional view diagram illustrating another two examples of the electret layer of FIG. 1.
Figure 3B:
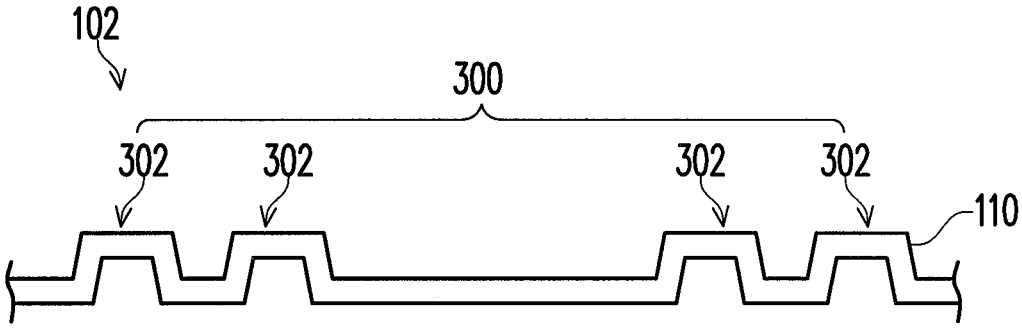

In another embodiment, the electret layer 102 can be formed having a pattern 300 formed by a plurality of corrugations 302 as shown in FIGS. 3A and 3B. The regions with the corrugations 302 have a thickness higher than those without corrugations 302, so the electret layer 102 also has the performance caused by different thickness in different region. Therefore, the frequency response of the speaker can be enhanced by the position of the corrugations 302 through the whole electret layer 102. The electret layer 102 of FIG. 3A includes the base material of fluorine polymer 112, but the electret layer 102 of FIG. 3A only includes the ethylene group polymer 110 without the base material of fluorine polymer. For clarity, the bonding layer 104 and the Al electrode layer 108 are not shown in FIGS. 3A and 3B.

Figure 4:
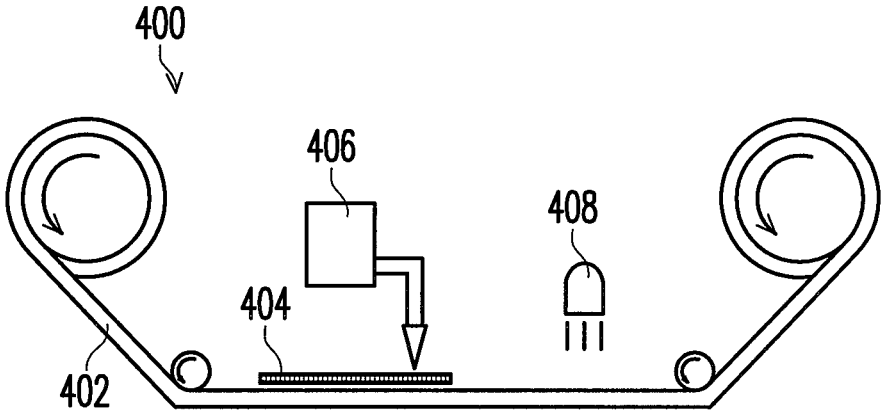
FIG. 4 is a schematic, cross-sectional view diagram illustrating a roll-to-roll apparatus for fabricating the electret layers of FIGS. 2A-2C.
Figure 5:
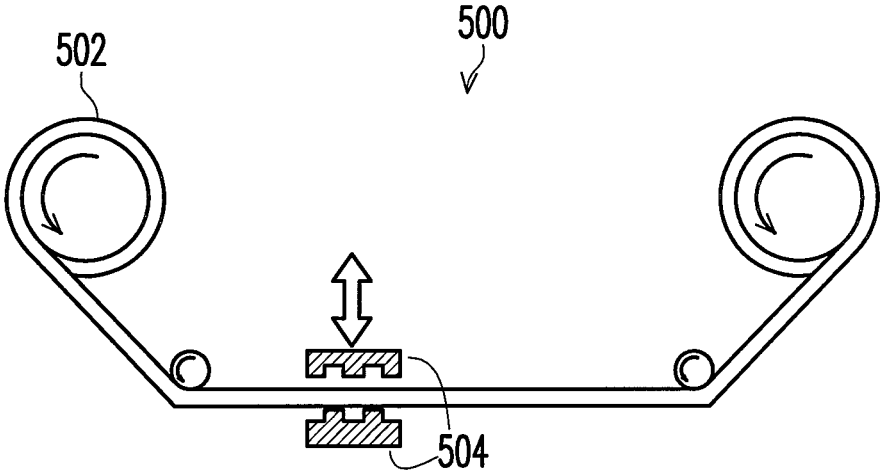
FIG. 5 is a schematic, cross-sectional view diagram illustrating a roll-to-roll apparatus for fabricating the electret layers of FIGS. 3A and 3B.

The electret layer 102 of FIGS. 2A-2C and 3A-3B may be made from the roll-to-roll process as shown in FIGS. 4 and 5, respectively.

In FIG. 4, the roll-to-roll process includes conducting a screen printing process, whereby thickening portions of the electret layer 102 to form the thick portions 202 in FIG. 2. For example, a roll-to-roll apparatus 400 is provided that includes a roll of electret layer 402, a screen 404, a printing device 406, and a IR source 408. Raw material of the ethylene group polymer 110 can be put in the printing device 406 and printed on the electret layer 102 through the screen 404. Afterwards, the printed electret layer 102 can be cured by the IR source 408.

In FIG. 5, the roll-to-roll process includes a molding process, whereby wrinkling or embossing the electret layer 102 to form the plurality of corrugations 302 in FIG. 3. For example, a roll-to-roll apparatus 500 is provided that includes a roll of electret layer 502 and a mold 504. When passing the roll of electret layer 502 through the mold 504, the mold 504 will close to make the electret layer 102 having corrugations.

The electret layer 102 may include holes having diameters in micro-scale or nanometer-scale. Because the electret layer 102 may keep static charges for an extended period of time and may have piezoelectric characteristics after subject to an electrifying treatment, the holes within the electret diaphragm 100 may increase transmission and enhance piezoelectric characteristics of the material.

In one embodiment, the ethylene group polymer 110 is formed on the base material of fluorine polymer 112 by providing a solution (i.e. a raw material of ethylene group polymer 110) on one surface of the base material of fluorine polymer 112 to form a wet film and curing the wet film. The solution can be provided on the surface of the base material of fluorine polymer 112 by coating, wetting or screen printing, for example. The wet film is cured by backing through heating or radiation, for example. The solution includes an ethylene group polymer material. In an embodiment, the solution further includes additives such as inorganic nanoparticles. Example of the nanoparticles such as $Al_2O_3$, $Bi_2O_3$, $SiO_2$, $TiO_2$, $BaTiO_3$, $CaCO_3$ or $Si_3N_4$.

In one embodiment, the raw material of ethylene group polymer 110 is dissolved in a solvent. The solvent includes toluene, xylene, p-xylene, chloroform, N-methylpyrrolidone (NMP), dimethylformamide (DMF) or tetrahydrofuran (THF), for example. During the wet film is cured, the solvent is removed from the wet film.

Figure 6:
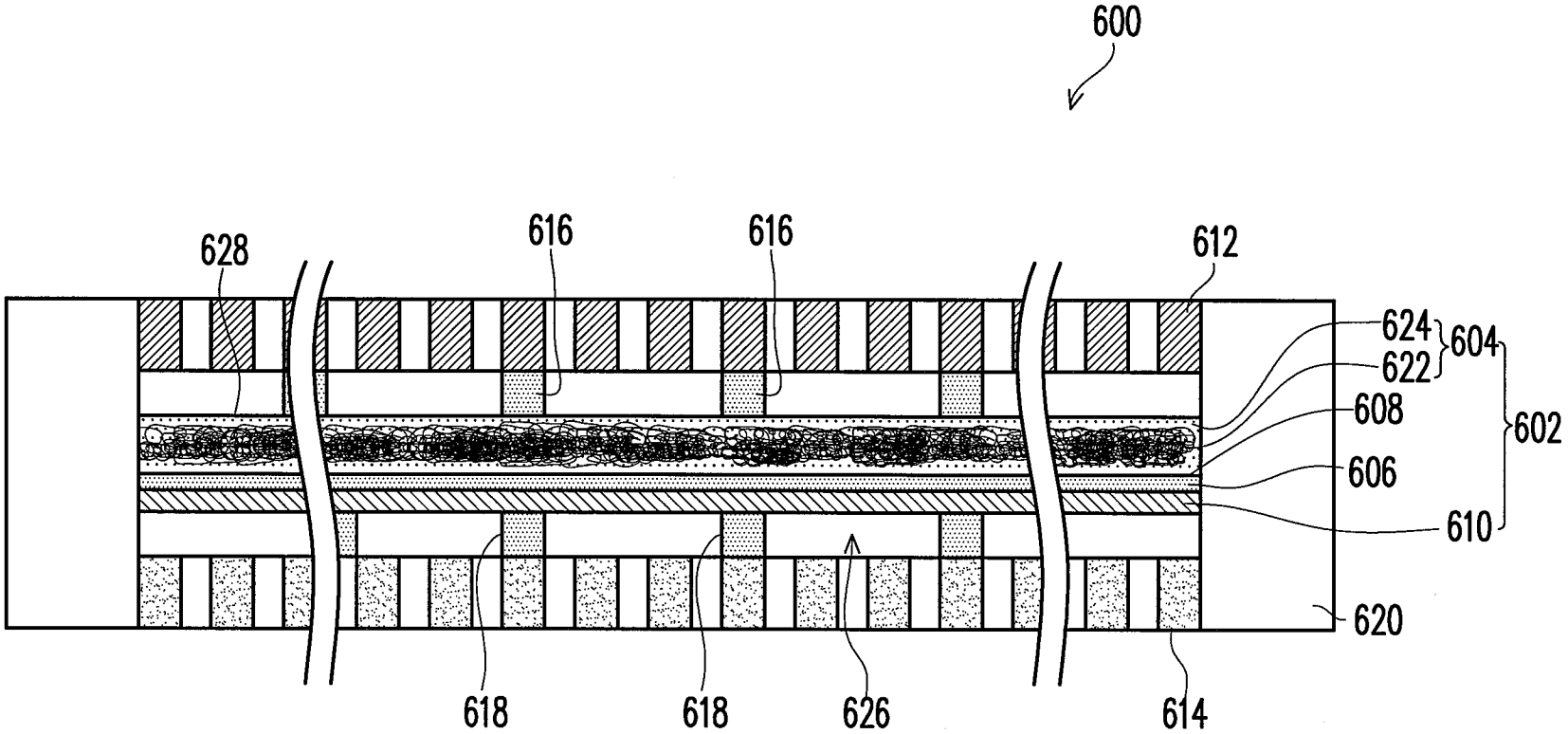
FIG. 6 is a schematic, cross-sectional view diagram illustrating a speaker according to another exemplary embodiment of the disclosure.

FIG. 6 is a schematic, cross-sectional view diagram illustrating a speaker according to another exemplary embodiment of the disclosure.

Referring to FIG. 6, the speaker 600 at least includes an electret diaphragm 602 containing an electret layer 604, a bonding layer 606 adhered to a surface 608 of the electret layer 604, and an aluminum (Al) electrode film 610 adhered on the bonding layer 606. For example, the Al electrode film 610 may be formed by evaporation, sputtering, coating or screen printing.

The speaker 600 may further include a perforated electrode layer 612, a perforated plate 614, The electret diaphragm 602 is installed between the perforated electrode layer 612 and the perforated plate 614.

Moreover, a first spacer member 616 may be sandwiched by the electret diaphragm 602 and the perforated electrode layer 612, and a second spacer member 618 may be sandwiched by the Al electrode film 610 and the perforated plate 614. In addition, the electret diaphragm 602, the perforated electrode layer 612, and the perforated plate 614 may be installed into a frame or frame supporting member 620.

The electret layer 604 at least includes a base material of fluorine polymer 622 and an added material of ethylene group polymer 624. The examples of the base material of fluorine polymer 622 and the added material of ethylene group polymer 624 can refer to the above exemplary embodiment, and the structure of the electret layer 604 may use one of the electret layer 102 in FIGS. 1-3.

Taking the electret layer 604 with negative charges as an example, when an input audio signal is supplied to the perforated electrode layer 612 and the Al electrode film 610, a positive voltage from the input signal may produce an attracting force on the negative charges of the electret diaphragm 602, and a negative voltage from the input signal may produce a repulsive force on the positive charges of the speaker 600 so as to make the electret diaphragm 602 moving in one direction.

In contrast, when the voltage phase of the input sound source signal is changed, a positive voltage may produce an attracting force on the negative charges of the electret diaphragm 602, and a negative voltage may produce a repulsive force on the positive charges of the speaker 600 so as to make the electret diaphragm 602 moving in the direction opposite to the above-mentioned direction. The electret diaphragm 602 may move back-and-forth repeatedly and vibrate to compress the surrounding air to produce sound through the interaction of different forces in different directions.

At the side of the electret diaphragm 602 opposite to the perforated electrode layer 612, there is the sound-chamber structure 626, which may be enclosed or partially-enclosed by the perforated plate 614 and the second spacer members 618. In some embodiments, a surface 628 opposite the surface 608 of the electret layer 604 may be conductively coupled to the frame supporting member 620 and the first spacer members 616.

Both the first spacer members 616 and the second spacer members 618 may be adjusted, as part of the speaker design, in their placements, heights, and/or shapes. In addition, the number of the second spacer members 618 can be greater than, equal to or less than the number of the first spacer members 616, and the first or second spacer members 616 or 618 can be fabricated directly on or over the perforated electrode layer 612 or the perforated plate 614.

The perforated electrode layer 612 can be made of metal by evaporation, sputtering, coating or screen printing, for example. In one embodiment, the perforated plate 614 can be made of an elastic material, such as paper or an extremely-thin, nonconductive material, plated with a metal film on the paper or the nonconductive material.

When the perforated electrode layer 612 is made of a nonconductive material layer plated with a metal film layer, the nonconductive material can be plastic, rubber, paper, nonconductive cloth (cotton fiber or polymer fiber) or other nonconductive materials, wherein the metal film can be aluminum, gold, silver, copper, Ni/Au bimetal, indium tin oxide (ITO), indium zinc oxide (IZO), macromolecule conductive material PEDOT (polyethylenedioxythiophene), etc.; an alloy; or any combination of the listed material or equivalents thereof. When the perforated electrode layer 612 is made of a conductive material, the conductive material can be metal (iron, copper, aluminum or an alloy thereof), conductive cloths (metal fiber, oxide metal fiber, carbon fiber or graphite fiber), etc., or any combination of these materials or other materials.

In one embodiment, the speaker 600 may be covered by a protective film (not shown) on one side or on both sides except for the frame supporting member 620. The protective film may be air-permeable but waterproof and made of, for example, GORE-TEX® film containing porous polytetrafluoroethylene, etc. GORE-TEX® or a similar material may be capable of preventing the effects of water and oxygen so as to prevent the electret layer 604 from leaking its charges and having its stationary electric effect reduced.

The electret diaphragm 602 is performed a corona discharging process or an electrical polarization process. In one embodiment, control of treatment conditions, such as temperature, humidity, and level of discharge, may be used to adjust or improve charging effects.

Several experimental results are discussed below to demonstrate the effect of the anode material of the exemplary embodiments in the disclosure.

Experiment 1: Preparation of Composite Porous PTFE/COC Layer

The COC Topas® 6013 with a 7.5 wt % concentration is dissolved in toluene to form a COC solution and measured to have 12.1 cp viscosity by using a viscosity meter (SV-10, A&D scientech, Taiwan). First, the coating of porous PTFE film with COC solution was prepared by spin coating. The COC solution can be infiltrated into the cavity of porous PTFE membrane, then the density and uniform of the composite films are controlled by the 2000 rpm of spin speed. The embryo composite films specimens have good integrated between the fibrous PTFE and the COC with a mechanical adhesion. After first step, the embryo specimens are annealed for four hours at 100° C. in order to remove toluene residues.

Experiment 2: Preparation of Porous PTFE/COC/EEA Electret Diaphragm

The EAA with a 0.5 wt % concentration is also dissolved in toluene to form EAA solution. Repeat the above step, the coating of embryo specimens with EAA solution was prepared by spin coating again. Finally, an e-beam evaporator was used to evaporate 100 nm of the aluminum layer onto the composite films.

Result 1: SEM Morphology of Composite Porous PTFE/COC Layers

Figure 7:
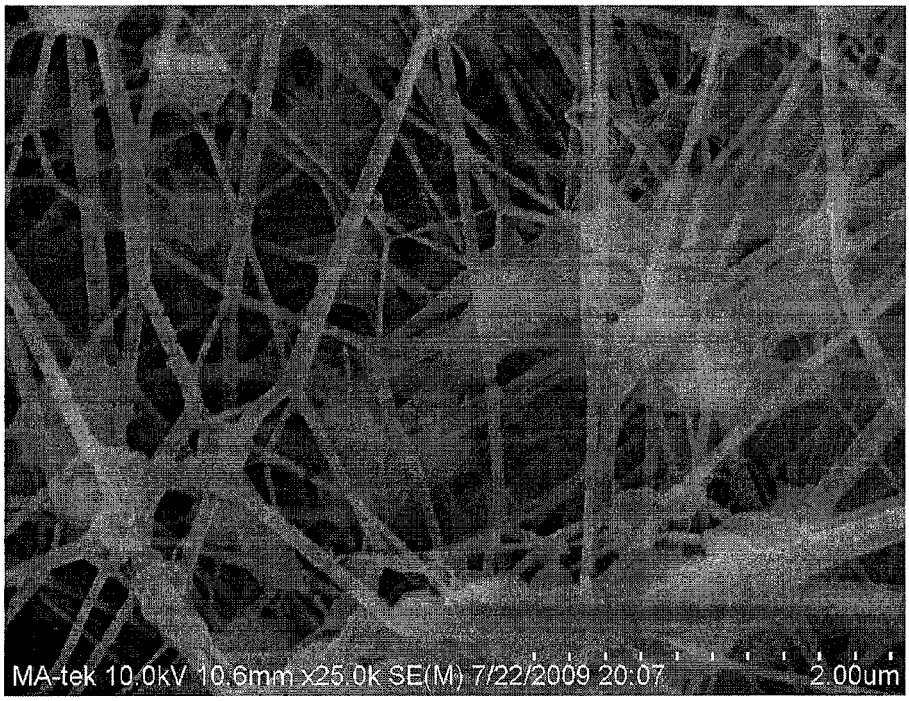
FIG. 7 is a scanning electron microscope (SEM) image of the standard porous PTFE.
Figure 8:
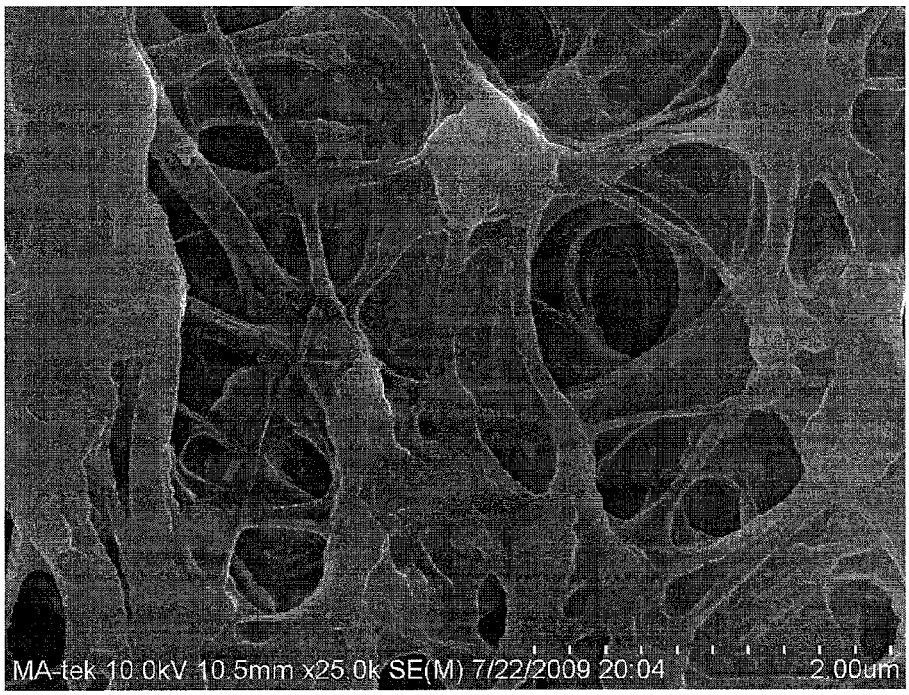
FIG. 8 is a SEM image of the composite porous PTFE/COC layer.

To investigate and compare the cause of a COC addition on morphology of composite material, the surface of the specimens is studied using a scanning electron microscope (SEM). In FIG. 7, the SEM images of the standard porous PTFE clearly show a porous structure at the outer surfaces and has an open-porous structure and high porosity under high SEM magnification. The morphology of the composite porous PTFE/COC layer is obtained as shown in FIG. 8. Results show the COC penetrated the cavities of the porous PTFE and filled in some of the space therebetween. In detail, the composite material shows good mechanical adhesion between the porous PTFE and the COC. Comparing a standard porous PTFE, the porosity of the composite films is reduced significantly.

Result 2: Electret Properties of Composite Porous PTFE/COC Layers

Figure 9:
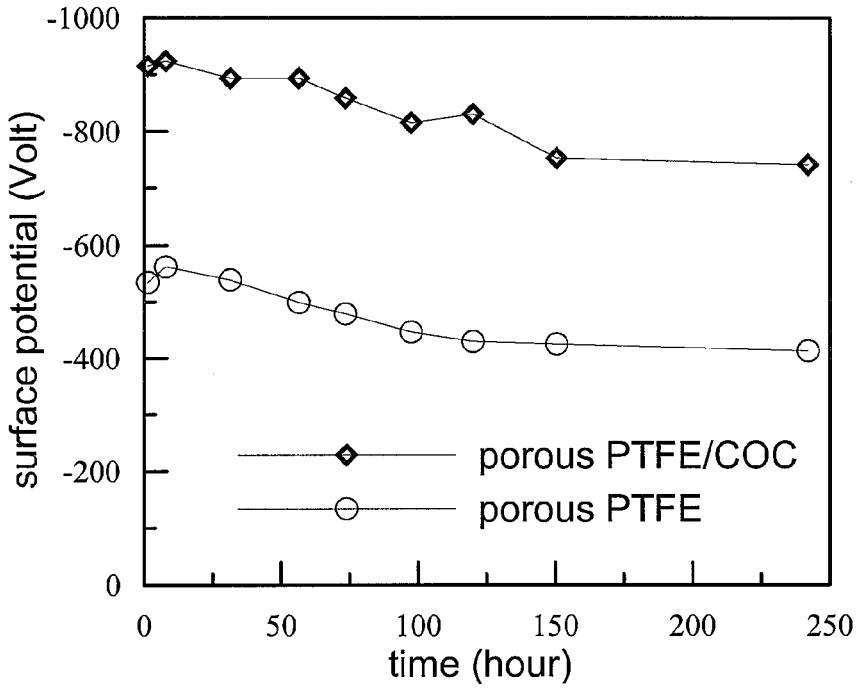
FIG. 9 is a curve of measured static surface potential for porous PTFE and the composite porous PTFE/COC layer at room temperature.

The charge storage capability of electret samples at room temperature is determined by measuring the surface potential remaining over time. Both the standard porous PTFE and the composite porous PTFE/COC layer are first charged by a corona treatment. The electret properties of these specimens are then measured and recorded over time at room temperature (e.g. 25° C. and 30% RH). For each kind of specimen, at least 3 samples are taken and measured. Experimental results (refer to FIG. 9) indicate that the surface potential of the standard porous PTFE film exists at a stable surface potential of around −410V, whereas the surface potential of the exists at a stable surface potential of around −750V. That is, under the same charge conditions, the composite porous PTFE/COC layer is characterized by a better charge storage capacity than that of the standard porous PTFE film. At room temperature, it appears that in comparison with the standard porous film, the surface potential of the composite porous PTFE/COC layer is effectively enhanced by about 80% after COC having the mass of about 20% of the mass of the PTFE is coated onto the porous PTFE film at room temperature.

Figure 10:
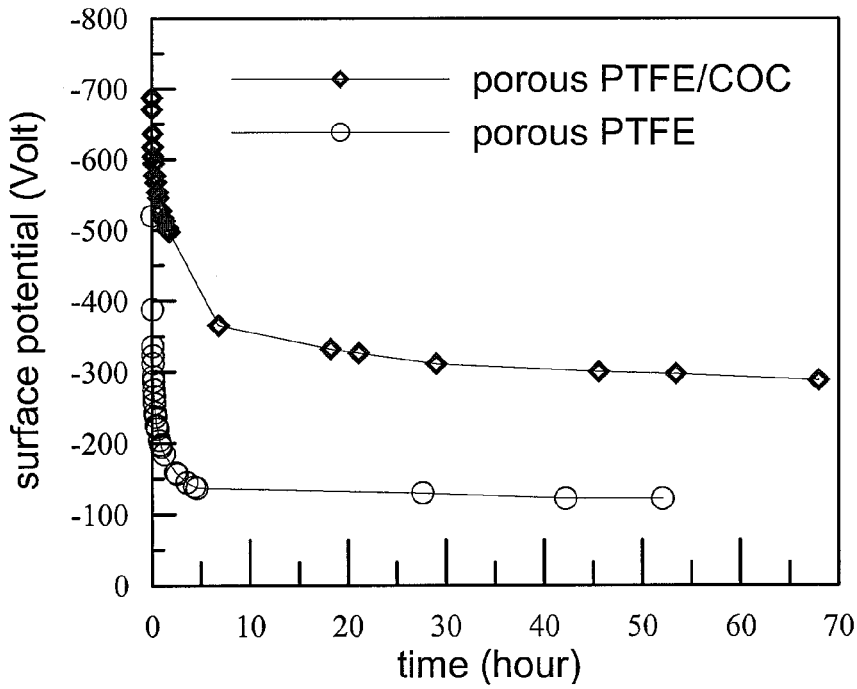
FIG. 10 is a curve of measured static surface potential for porous PTFE and composite porous PTFE/COC layer at 100° C.

For future automobile applications, electret diaphragms with good temperature resistance are necessary. Both standard porous PTFE and composite porous PTFE/COC layers are placed in an oven at 100° C. and observed for surface potential decay under the same conditions as for the case of the corona charging. More specifically, the charge storage stability of the temperature resistance is investigated. From the experimental data (refer to FIG. 10), the charge is found to be quickly lost due to the influence of the high temperature during the early stage. Five hours later, the surface potential is found to be at a stable condition. Results showed that standard porous PTFE with 24 μm thickness has a poor charge storage stability at high temperature. The surface potential of the composite film with 25 μm thickness, however, possessed excellent charge storage stability when compared to that of the standard porous PTFE. Therefore, it appears that the composite porous PTFE/COC layer can effectively enhance a stable surface potential to about 140V at 100° C.

At present, the mechanism of a storage charge remains unclear. Several possible reasons include the following: (1) the COC is an amorphous copolymer which has glass transition temperature higher than 140 degrees C. The COC also possesses good electret properties and has a higher thermal resistance than PP. When COC and porous PTFE come together to form the composite porous PTFE/COC layer, more interfaces are formed which lead to a higher storage capability. (2) The appropriate ratio of COC and fibrous PTFE has been investigated. An original open structure of porous PTFE is transformed into a semi-open structure so as to reduce its porosity. Possible reasons for the increased charge storage stability of the composite film include the generation of a barrier by the semi-open porous structure within the membrane thickness, which prevented the charge from drifting. In addition, COC may be a bound variant of the thermal expansion of PTFE to reduce its molecular chain movement at 100° C., which in turn reduces the charge loss.

Result 3: Mechanical Properties of the Composite Porous PTFE/COC Layers

Figure 11:
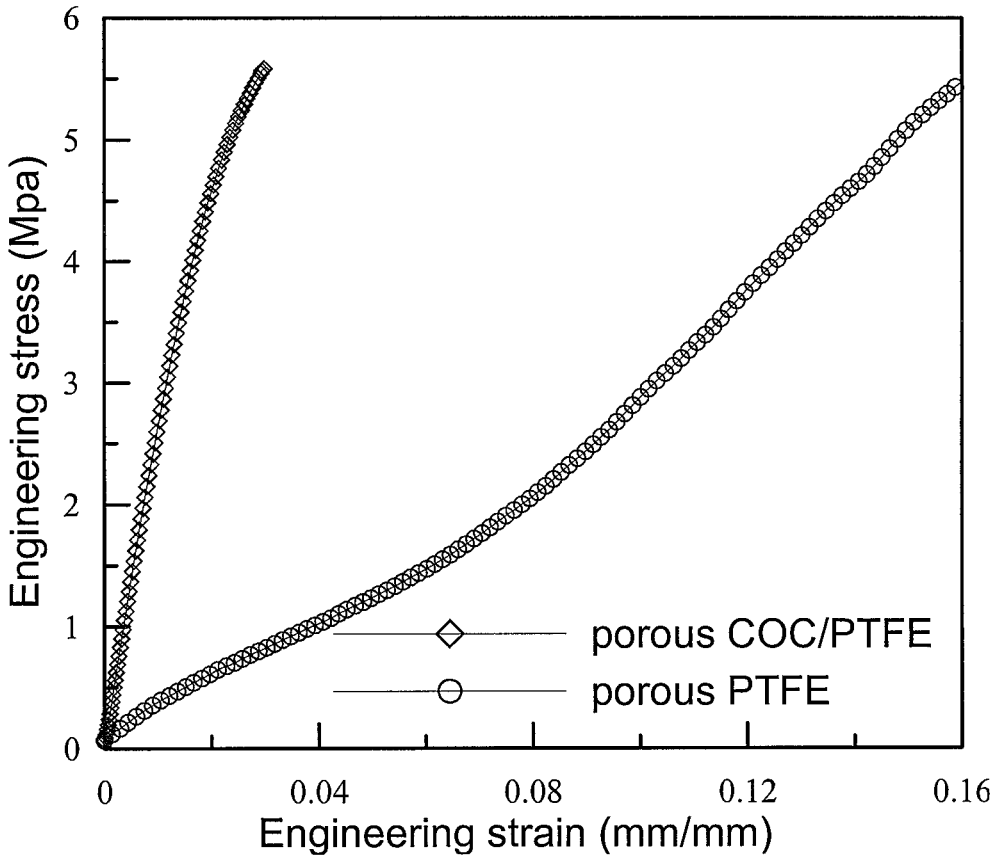
FIG. 11 is an engineering stress-strain curve of porous PTFE and composite porous PTFE/COC layer.

The elastic modulus of the sample is the ratio of stress to strain within the range of the elastic limit. The elastic modulus of standard porous PTFE is calculated to be within the range of 0 to 0.02 mm/mm for strain and with an average value of 30.79 Mpa. Comparing the elastic modulus between a standard porous PTFE and composite porous PTFE/COC layer (refer to FIG. 11), it is clear that the composite porous PTFE/COC layer possesses a higher elastic modulus. The elastic modulus of the composite porous PTFE/COC layers is found to be 228.86 Mpa, which is 643.3% higher than that of the standard PTFE material. In FIG. 11, the standard porous PTFE generates a large tensile deformation at low stress which can create problems when being applied to electret speakers. In Table 1, it is found that adding a COC amount of 0.2204 mg/cm$^2$, the mechanical strength may be effectively enhanced and the low stress deformation found with standard porous PTFE may be overcome.

TABLE 1

| Polymer Film Type | Mass Per Unit Area (mg/cm$^2$) | Thickness (μm) |
|---|---|---|
| Porous PTFE | 1.1314-1.1550 | 24 ± 2 |
| Composite porous PTFE/COC | 1.3182-1.44 | 25 ± 2 |

To achieve low cost and ease of production, an aluminum layer is used to serve as the electrode layer for the above composite porous PTFE/COC layer. To solve the poor adhesion between the aluminum layer and the PTFE, a polymer EEA is utilized as the bonding layer. The cross-cut tests is ASTM D3359. According to the results, the EEA can effectively improve the adhesive strength of the aluminum layer and the composite porous PTFE/COC layer. A surface measurement value of 3 B (5-15% damage) is obtained which shows it to be far more effective than that of the original material with value at 0 B (100% damage).

Experiment 3: Fabricated of the Flexible Speaker

Figure 12:
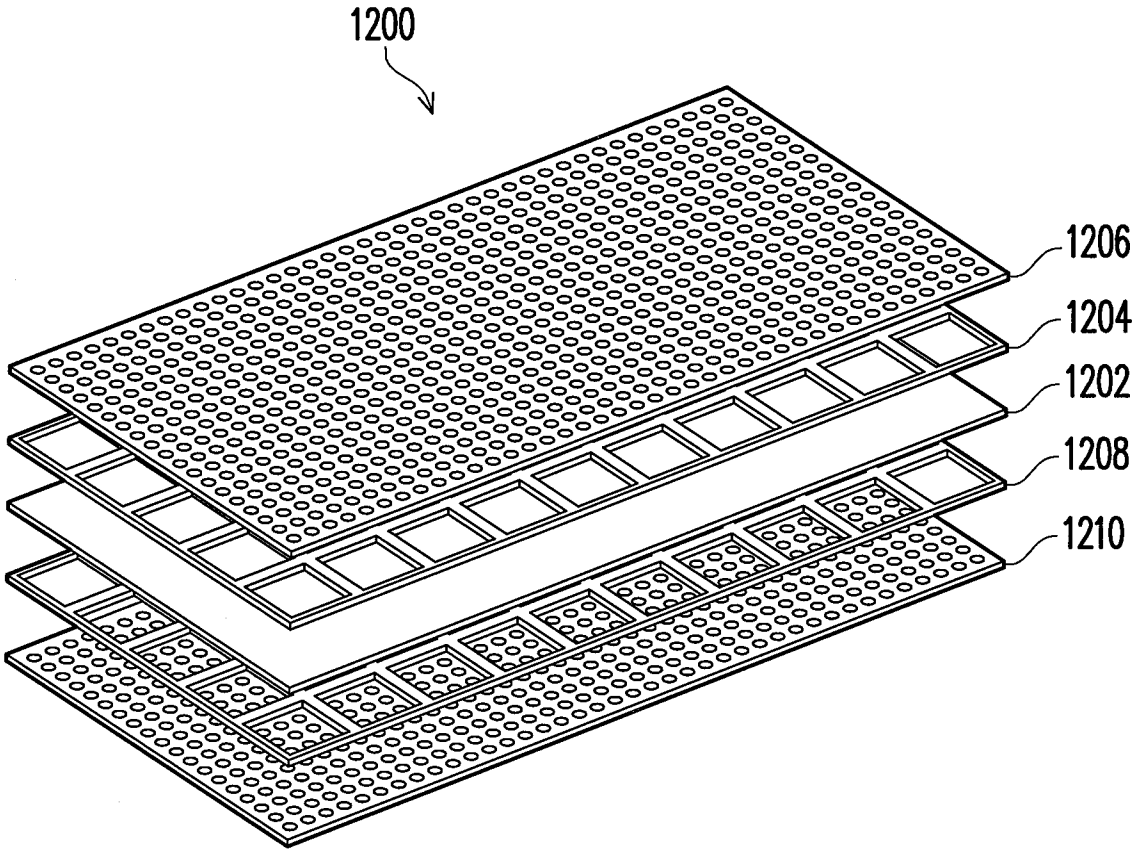
FIG. 12 is an exploded diagram illustrating a flexible speaker of Experiment 3.

After the electret diaphragm is fabricated as above, a flexible speaker 1200 is manufactured as shown in FIG. 12. The electret diaphragm 1202 is charged by using a set of corona discharging and retains space charge therein, first. The spacers 1204 are used to set the air gap between the charged electret diaphragm 1202 and the perforated electrode layer 1206; and the pacers 1208 are used to set the air gap between the charged electret diaphragm 1202 and the perforated plate 1210. In addition, the spacers 1204 and 1210 of the arrangement of latitude and longitude lines are also determined the size of each cell actuators in FIG. 12. The air gap between the charged diaphragm 1202 and the perforated electrode layer 1206 is 150 μm and the perforated electrode layer 1206 has 30 percent of perforation ratio. Furthermore, the air gap between the charged diaphragm 1202 and the perforated plate 1210 is also 150 μm and the perforated plate 1210 has 30 percent of perforation ratio.

The resulting speaker has a length of 90 mm, a width of 90 mm and a thickness of 0.3 mm. The cell actuators of the resulting speaker are with 8 mm square and arrange to form an arrayed structure.

Figure 13:
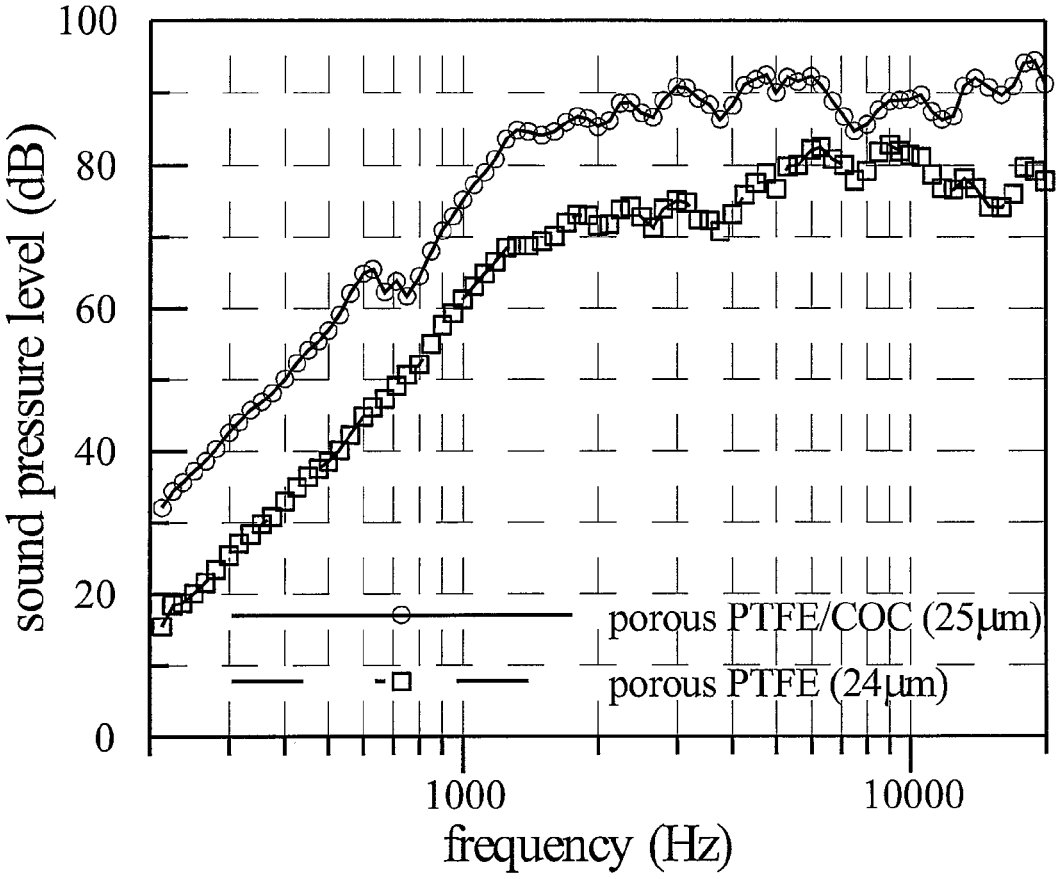
FIG. 13 is an on-axis sound pressure level (SPL) curves of the flexible speaker with porous PTFE and composite porous PTFE/COC layer.

FIG. 13 shows the on-axis sound pressure level (SPL) curves of the different material of speakers. Measurement distance is 25 cm. Results show that the SPL for speaker using the composite porous PTFE/COC layer is about 88 dB at 2 kHz, and the SPL for speaker using the raw porous PTFE is about 13.6 dB at 2 kHz. The frequency response of improved speaker is flat between 1.2 k to 20 kHz. The sound quality is acceptable enough to enjoy the content in audio need.

This composite porous PTFE/COC layer can improve the elastic modulus and create a better adhesion to the aluminum layer. In addition, the surface potential of composite porous PTFE/COC layer electret film with 25 μm thickness possessed also has excellent charge storage when compared to that of a porous PTFE. All these performances can lead to a much improved electret diaphragm for flexible electret speaker applications. Therefore, it appears that the composite porous PTFE/COC can effectively enhance the surface potential by about 80% and comparing with the raw material only to increase the weight of 19%. Hence, according Coulomb's law and structure of the electret actuator, the improved electret diaphragm would help to increase the SPL of flexible electret speaker.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. An electret diaphragm, comprising:

an electret layer, at least comprising nonfluorine ethylene group polymer and a base material of fluorine polymer, wherein the nonfluorine ethylene group polymer is infiltrated into the base material of fluorine polymer; and a bonding layer, adhered to a surface of the electret layer, wherein a material of the bonding layer comprises ethylene-ethyl-acrylate (EEA) or ethylene-vinyl acetate (EVA); and an aluminum (Al) electrode layer, adhered to the bonding layer.

2. The electret diaphragm of claim 1, wherein the base material of fluorine polymer comprises fabric type polymer, nonwoven type polymer, or porous type polymer.

3. The electret diaphragm of claim 1, wherein the base material of fluorine polymer comprises porous polytetrafluoroethylene (e-PTFE).

4. The electret diaphragm of claim 1, wherein the nonfluorine ethylene group polymer comprises cyclic olefin copolymer (COC), polyvinyl chloride (PVC), or polyethylene (PE).

5. The electret diaphragm of claim 1, wherein the electret layer has a pattern constituted by a plurality of thick portions and a plurality of thin portions.

6. The electret diaphragm of claim 5, wherein the Al electrode layer is in the plurality of thick portions except for the plurality of thin portions.

7. The electret diaphragm of claim 1, wherein the electret layer has a pattern formed by a plurality of corrugations.

8. The electret diaphragm of claim 1, wherein the bonding layer and the Al electrode layer are patterned to a predetermined shape.

9. The electret diaphragm of claim 1, wherein the bonding layer and the Al electrode layer are patterned to disconnected array patterns.

10. The electret diaphragm of claim 1, wherein the bonding layer and the Al electrode layer are patterned to partially connected array patterns and partially disconnected array patterns.

11. A speaker, comprising:

a perforated electrode layer; and at least one electret diaphragm, opposite to the perforated electrode layer, wherein the electret diaphragm comprises an electret layer, a bonding layer adhered to a surface of the electret layer, and an aluminum (Al) electrode layer adhered on the bonding layer, wherein the electret layer at least comprises a material of nonfluorine ethylene group polymer and a base material of fluorine polymer, and a material of the bonding layer comprises ethylene-ethyl-acrylate (EEA) or ethylene-vinyl acetate (EVA), wherein the material of nonfluorine ethylene group polymer is infiltrated into the base material of fluorine polymer.

12. The speaker of claim 11, wherein the base material of fluorine polymer comprises fabric type polymer, nonwoven type polymer, or porous type polymer.

13. The speaker of claim 11, wherein the base material of fluorine polymer comprises porous polytetrafluoroethylene (e-PTFE).

14. The speaker of claim 11, wherein the material of nonfluorine ethylene group polymer comprises cyclic olefin copolymer (COC), polyvinyl chloride (PVC), or polyethylene (PE).

15. The speaker of claim 11, wherein the electret layer has a pattern constituted by a plurality of thick portions and a plurality of thin portions.

16. The speaker of claim 15, wherein the Al electrode layer is in the plurality of thick portions except for the plurality of thin portions.

17. The speaker of claim 11, wherein the bonding layer and the Al electrode layer of the electret diaphragm are patterned to a predetermined shape.

18. The speaker of claim 11, wherein the bonding layer and the Al electrode layer are patterned to disconnected array patterns.

19. The speaker of claim 11, wherein the bonding layer and the Al electrode layer are patterned to partially connected array patterns and partially disconnected array patterns.

20. The speaker of claim 11, wherein the electret layer has a pattern formed by a plurality of corrugations.

21. The speaker of claim 11, further comprising a first spacer member sandwiched by the electret diaphragm and the perforated electrode layer.

* * * * *